United States Patent [19]

Asel et al.

[11] 4,046,088

[45] Sept. 6, 1977

[54] APPARATUS FOR SEWING RINGS, BUCKLES AND THE LIKE ELEMENTS ONTO TAPE

[75] Inventors: John R. Asel, Lorraine; Roger Allaire, St. Leonard; Peter Thalmann, Lachine; René Castonguay, Montreal, all of Canada

[73] Assignee: Canadian Lady-Canadelle Inc., W. Montreal, Canada

[21] Appl. No.: 679,425

[22] Filed: Apr. 22, 1976

[30] Foreign Application Priority Data

May 14, 1975 United Kingdom ..... 20441/75

[51] Int. Cl.[2] ..... D05B 3/12

[52] U.S. Cl. ..... 112/265; 223/49; 112/121.27

[58] Field of Search ..... 112/104, 121.15, 121.12, 112/121.27, 121.25, 27, 86, 102, 265; 223/1, 49

[56] References Cited

U.S. PATENT DOCUMENTS

| | | | |
|---|---|---|---|
| 2,699,275 | 1/1955 | Mulligan | 223/49 |
| 2,770,204 | 11/1956 | Brownstein | 223/49 X |
| 2,955,730 | 10/1960 | Sonntag et al. | 223/49 |
| 3,422,999 | 1/1969 | Fisher | 223/49 |
| 3,497,116 | 2/1970 | Herron et al. | 223/49 |

FOREIGN PATENT DOCUMENTS

| | | | |
|---|---|---|---|
| 686,468 | 1/1953 | United Kingdom | 223/49 |

*Primary Examiner*—G. V. Larkin

*Attorney, Agent, or Firm*—Beveridge, DeGrandi, Kline & Lunsford

[57] ABSTRACT

Apparatus for forming components of shoulder straps for ladies garments including tapes with either a buckle or a ring sewn onto one end. The apparatus allows the sewing to be performed with a non-linear seam, by means of a sewing machine of the type which moves its bed and sewing foot through a predetermined path while sewing is being performed by a needle. The apparatus includes a special holding device for the ring or buckle element which allows this movement to occur, the holding device including a main body part and a holding part, the holding part having clamping means for the element. The body part is movable to suitably position the holding part firstly in a position to receive an element from a magazine and secondly in the sewing position. The holding part and body part have interengaging sliding surfaces allowing movement of the holding part relative to the body part in a plane parallel to those parts of the tape clamped by the sewing foot and bed when the body part is in the sewing position, and the body part includes releasable locking means for locking the holding part firmly in the body part during transfer of an element from the magazine to the holding part, and during movement of the device to the sewing position. The locking means are releasable so that the holding part is free to move with the tape being sewn, during sewing.

15 Claims, 23 Drawing Figures

SEE FIG-3A
4
14
14a
281
42
281a
267
14a
228
226
14
284
270
260
274
280
283
282
272
44
46
262
244
207
212b
206
200
38
288
250
204
40
202
287
224
237
237a
239
45
235
257
220
235
48
252
252a
221
230

APPARATUS FOR SEWING RINGS, BUCKLES AND THE LIKE ELEMENTS ONTO TAPE

The present invention relates to devices and apparatus for forming components of shoulder straps for ladies garments particularly brassieres. Such a shoulder strap is formed of two parts united together, namely a first strap portion comprising a first tape with a buckle (or so-called slide) secured to one end, and a second strap portion comprising a second tape having a ring secured thereto, the two strap portions being united by passing a free end of the first tape through the ring and then back through the two slots of the buckle. A strap of this kind, which is well known in the art, will be referred to hereinafter as being "of the type described." The first tape is preferably inelastic, and the second tape is preferably elastic.

The buckle and ring are conventionally secured to their respective strap portions by sewing together a main portion of the respective tape and an end portion thereof after the latter portion has been passed through the two slots of the buckle or through the ring as appropriate. However, instead of sewing, an ultrasonic welding step may be used with appropriate synthetic fabrics. The term "joining machine" will be used to signify either a sewing machine or another type of machine, for example an ultrasonic welding machine, which can join together two parts of a tape.

Manufacture of these shoulder straps has hitherto involved much manual labour. The only machine known to applicants which manufactures shoulder straps of this type is the machine shown in U.S. Pat. No. 3,497,116 to Herron et al, which issued Feb. 24, 1970. The Herron machine is complicated, and is understood to be not entirely satisfactory in operation. The present invention is concerned with a machine which is different from that of the Herron machine in very many ways. One particular difference lies in the arrangement used to unite the two parts of the strap together when these have been formed in different parts of the machine; this arrangement is the subject of our U.S. patent application Ser. No. 679,424 (Case I) filed concurrently herewith.

The aforesaid application relates principally to operations relating to the uniting of the strap portions which occur in a third section of the machine. The present invention is concerned with first and second sections of the machine which form the first and second strap portions respectively, and which could be used, if desired, quite independently to produce the strap portions, without any means for uniting the two portions. These sections of the machine differ in various respects due to the fact that the first section has to combine the tape with a buckle which requires that the tape be threaded through two slots, whereas the second (elastic) tape is merely pushed once through the ring before being sewn in position. These sections do however have various features in common, and one such special feature of these sections is the arrangement whereby desired forms of seam, and particularly zig-zag seams, are used for sewing the buckles and rings in place onto the respective tapes.

Zig-zag seams can be produced by known sewing machines of the bar-tack type having a bed and co-operating sewing foot capable of moving material clamped therebetween through a zig-zag path to sew the required seam. The present invention provides special means for holding the ring or buckle element which allows use of such machines.

Thus, in accordance with one aspect of the invention, a holding and transfer device for holding an element such as a ring, buckle or the like while said element is being sewn onto a tape by a sewing machine equipped with a sewing foot and bed capable of moving a tape clamped therebetween through a predetermined path to sew a non-linear seam across the tape, comprises a main body part and a holding part, said holding part having clamping means for said element, said body part being movable to suitably position said holding part firstly in a receiving position to receive said element from a supply source and secondly in a sewing position in which said element is disposed adjacent said foot and bed of the sewing machine and so positioned that after threading of said tape through said element parts of said tape adjacent said element may be clamped between said foot and said bed for sewing, and said holding part and said body part having inter-engaging sliding surfaces for movement of said holding part relative to the body part in a plane parallel to those parts of the tape clamped by said foot and bed when the body part is in said second position, said body part including releasable locking means for locking said holding part firmly in said body part during transfer of an element from said supply source to said holding part and during movement of said device to the sewing position, said locking means being releasable when the device is in the sewing position so that the holding part is free to move with the tape being sewn which is moved through said predetermined path by the sewing foot and bed.

In accordance with another aspect of the invention, apparatus for securing an element such as a ring, buckle, or the like onto a tape comprises:

a. a sewing machine equipped with a sewing foot and bed capable of moving a tape clamped therebetween through a predetermined path of movement to sew a non-linear seam across the tape, b. a source of supply of said elements, c. a holding and transfer device as hereinbefore described for receiving an element from said source and holding said element clamped, d. a source of supply of said tape, and e. means for feeding said tape to a position adjacent said element and for feeding a free end of said tape through said element while the element is held by the clamping and transfer device.

The holding and transfer device may include a horizontally movable carriage for moving the ring from a tape threading station to a sewing or joining position. Thus, in accordance with another aspect of the invention, apparatus for securing a ring to a tape includes a joining machine, means for supplying horizontally disposed rings to a delivery point, a ring holding and transfer device arranged to receive the horizontally disposed rings when fed thereto at the delivery point, tape advancing means for advancing tape in a first direction to position a free end of the tape in overlapping relationship with the ring, means for punching a free end portion of the tape through the ring, and means for moving the ring horizontally in said first direction into the operartive part of a joining machine thereby doubling the free end of the tape against a main portion of the tape to position both thicknesses of tape in the operative part of the joining machine.

Further in accordance with the invention, a method for securing a ring to a tape includes the steps of:

supplying a horizontally disposed ring to a delivery point and inserting said ring in a ring holding and transfer device, advancing tape in a first direction to position a free end of the tape in overlapping relationship with the ring, punching a free end portion of the tape through the ring, moving the ring horizontally in said first direction into the operative part of a joining machine thereby doubling the free end of tape against a main portion of the tape to position both thicknesses of tape in the operative part of the joining machine, and operating said joining machine to join the free end portion of tape to the main portion of the tape.

The term "ring" or "ring element" as used herein means an element having an aperture for receiving a tape therethrough, as for attaching said tape to another tape also received through the ring, and will be understood as not limited to a circular ring having only one aperture.

A specific embodiment of the present invention will now be described by way of example with reference to the accompanying drawings, which show general views of the whole machine and detailed views of the first and second strap forming sections, and in which:

FIGS. 1A and 1B show respectively plan and side views of a completed shoulder strap as formed by the machine, FIG. 2 shows a diagrammatic plan view of the whole machine taken on a plane just above the level occupied by the first and second tape during most of the machine operations, this drawing showing the division of the machine into the main sections A, B and C, FIGS. 3A and 3B show overall detail plan views of the left hand portions and right hand portions of the machine, respectively, FIGS. 4A and 4B are front elevations of the machine taken along line 4—4 FIGS. 3A and 3B respectively and showing the main components of sections A and B, FIG. 5 shows a perspective view of the left hand part of section A of the machine (as seen from the front) showing the parts in broken lines in a first position and in full lines in a second position, FIG. 6 shows a perspective view of the right hand part of section A of the machine (as seen from the front), with parts in a first position, FIG. 7 is a plan view of section A with the parts in the second position, FIG. 8 is an elevational view on line 8—8 of FIG. 7 with parts in a second position, FIG. 9 is an enlarged elevational view of a buckle holding and transfer device of section position, and FIG. 10 is a view of the same holding and transfer device on line 10—10 of FIG. 9, FIG. 11 is a perspective view of certain components of section B of the machine in a first position, FIG. 12 shows some of the same components in second position, FIG. 13 is a diagrammatic plan view of the main components of section B showing first, second, third and fourth positions of a ring holding and transfer device, FIG. 14 is a front elevation of section B of the machine showing the ring holding and transfer device in its first position, FIG. **14*a* is a front view of components of section B, similar to FIG. 14 but with the ring holding device removed, FIG. 14*b* is a view on 14*b*—14*b* of FIG. 3B showing the elastic tape advance device, FIG. 15 is an enlarged view of the ring holding and transfer device and the elastic threading station taken on line 15—15 of FIG. 13, FIG. 16 is a diagrammatic perspective view of parts of the ring holding and transfer device in two positions, FIG. 16*a* is a diagrammatic perspective exploded view of interior parts of the ring holding and transfer device, and FIG. 17** is a perspective view of the ring holding and transfer device showing additional parts.

The general features of the whole machine will firstly be described as a background to the detailed description of parts in accordance with this invention.

BRIEF SUMMARY OF MAIN COMPONENTS AND OPERATION OF MACHINE

The machine is designed to produce shoulder straps for brassieres, as illustrated in FIG. 1. The strap includes a first strap portion comprising a first tape 10 which is substantially inextensible and which preferably comprises an outer envelope of smooth polyester fabric which encloses a strong fabric strip. This tape has a buckle 12 sewn onto one end, by the tape having been passed through two slots in the buckle and sewn back onto itself along a seam about ½ inch from the buckle. The second strap portion comprises a second elastic tape 14 which has had its end passed through a ring 16 and been sewn back onto itself along a seam about ½ inch from the ring. The two strap portions are united by the first tape having been passed through the ring and then trough both slots of the buckle and pulled out to suitably position the buckle.

The basic components and operation of the machine will firstly be described in general terms with reference to FIGS. 2 and 3. These figures illustrate the three main sections into which the machine may be divided, namely a first section A which forms the first strap portion with the buckle, the second section B which forms the second (elastic) strap portion with the ring, and section c which unites these parts together to form the completed shoulder strap assembly.

In section A, tape 10 is supplied by a spool 20, and buckles 12 are supplied (orientated horizontally) by a magazine assembly 22. The buckles are moved from the supply position (shown in broken lines) to a vertical threading position (shown in full lines) adjacent the bed of a sewing machine 24 by means of a pivotable holding and transfer device indicated at 26, this being one of the devices with which the present invention is primarily concerned. The tape material 10 is fed endwise along a horizontal path between the open blades of a knife 28 by a so-called picker 30. This picker is movable horizontally and has thin blade-like clamping members which thread the end of the tape through the upper slot in a vertically disposed buckle held in the threading position by the device 26. The projecting outer end of the tape 10 is then locked in position relative to the buckle by a locking member indicated at 31, to allow the picker to withdraw, and the free end of the tape is bent downwardly across the central area of the buckle by an air blast from the tube 32. The bent end is then tucked back through the lower slot in the buckle by a horizontally movable blade 34 into a position under the main part of the tape and situated for sewing onto this main part by sewing machine 24. The projecting end of the tape is then sewn to the main portion by the sewing machine 24.

In section B meanwhile, a ring 16 is transferred from magazine assembly 38 to a ring holding and transfer device 40 which holds the ring horizontally; this is the other device with which the present invention is primarily concerned. The elastic tape 14 is then fed endwise from supply spool 42 by picker 44 which moves the tape between the open blades of knife 46 to a position in which an end portion of the tape overlies the ring 16. The path of movement of the tape is parallel to but spaced from the initial path of movement of tape 10 in section A. The end portion of the tape is then punched through the ring 16 by a downwardly operating punch moved by an air cylinder shown at 45 in FIG. 3B. Then the picker 44 withdraws after releasing the tape. Ring 16 is then moved horizontally by the device 40 over the bed of a sewing machine 48, in such manner that the projecting end of the tape is folded back under the main portion of the tape so that the machine can then be operated to sew the two portions of tape together around the ring. After sewing, the knife 46 is operated to sever a suitable length of elastic which remains attached to the ring, and the ring 16 with the tape attached is moved into the holding position shown at 40X in FIG. 3, the ring being simultaneously rotated to the vertical position with the tape 14 hanging from its lower side.

Turning to section C, the main operative parts of this section are the clamping devices 50 and 51. Both of these are mounted for translational movement towards and away from section A, and when the sewing operation has been completed in section A these clamping devices advance together to grip the tape 10. The first device 50 clamps the tape 10 adjacent the buckle 12, and the second device 51 clamps the tape just to the left hand side of knife 28, which is then operated to sever the tape 10. The device 51 has a narrow projecting end which extends (in the advanced position of device 51) away from buckle 12, and is suitable for threading the free end of the tape 10 both through the ring 16 and through a slot in the buckle, as will be described. The devices 50 and 51 then withdraw together to bring the tape into alignment with the original direction of movement of the elastic tape 14 and of ring 16 so that the projecting end of tape 10 is suitably aligned with the ring 16, which can then be moved onto the end of the tape by further movement of device 40 along the same path which this device moved in transferring the ring from the first position to the sewing position. The device 40 then releases the ring. Then, the clamping device 51 simultaneously rotates through 180 degrees and moves towards the device 50 to bring the projecting end of the tape 10 under the main portion of this tape, and final movement of device 51 inserts the projecting end of the tape through the lower slot of buckle 12. The end of tape 10 is then pushed upwardly by part 53 of a buckling device indicated generally at 54, and is tucked back through the upper buckle slot by a pneumatically operated blade 55 which is also part of the buckling device. A pulling device 57 (shown in FIG. 3A) mounted on an inclined slideway then grasps the projecting end of the tape 10 pulling a suitable amount through the buckle to give the final strap shown in FIG. 1. The completed strap is then removed by the ejector 59.

All movements described are caused by pneumatic cylinders, operated automatically.

In the detailed description which follows, reference will be made to lateral (leftward and rightward) directions, and fore and aft (forward and rearward) directions; these will be understood as directions in horizontal planes, with lateral directions being from side to side of the machine (parallel to the main paths of tape movement), and fore and aft directions being perpendicular thereto. A forward direction will be understood as meaning towards the front of the machine which is at the bottom in the plan views.

Detailed Description of Section A of Machine

Figure 7:
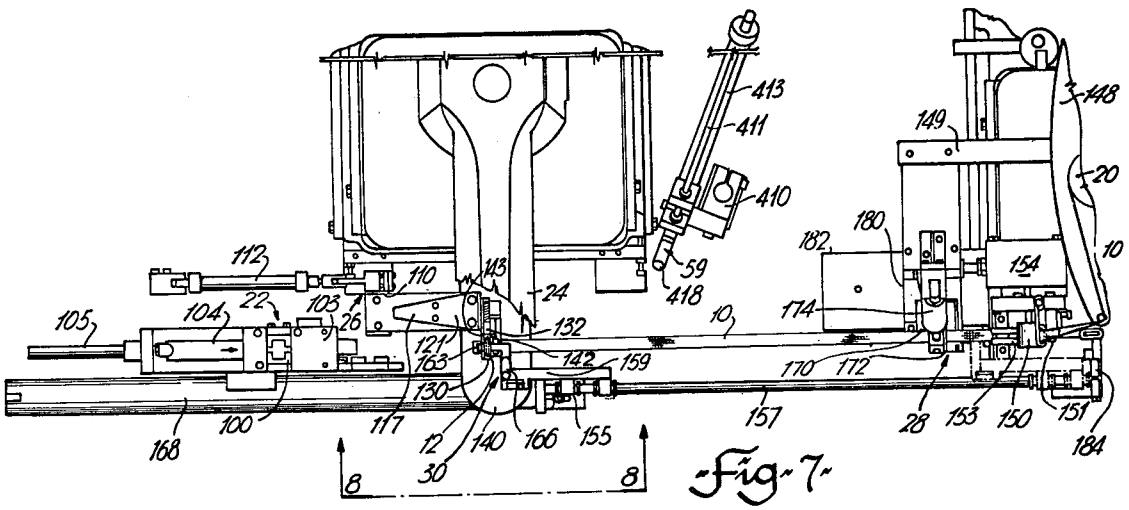
Figure 8:
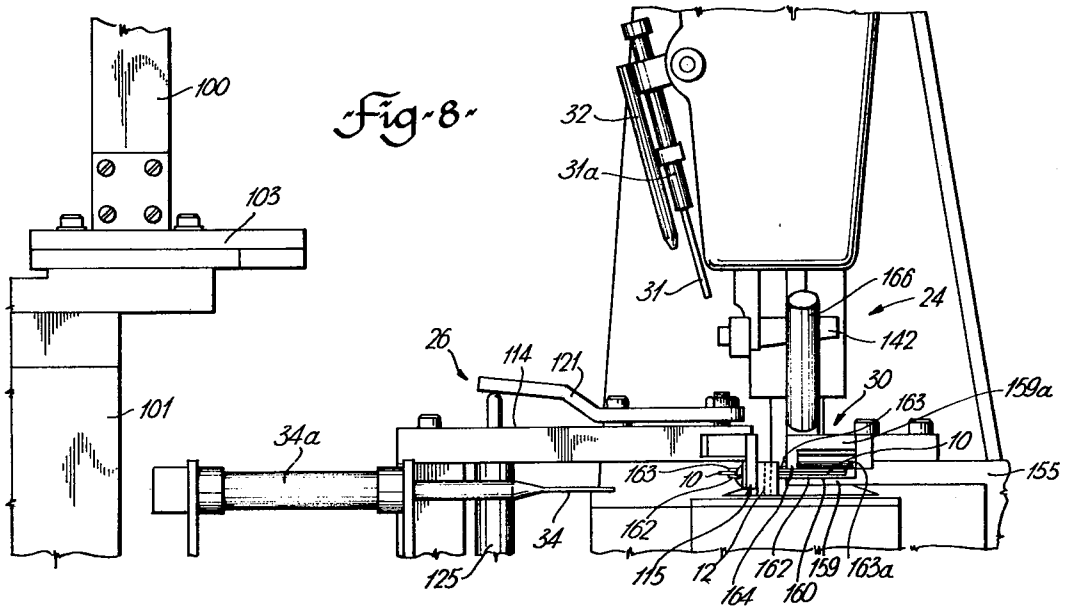
Figure 9:
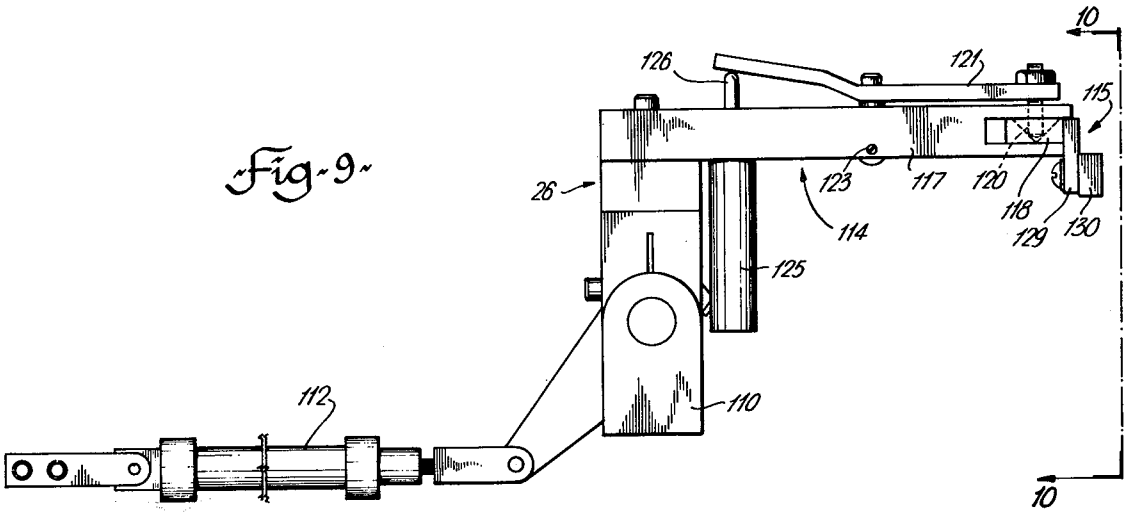
Figure 14B:
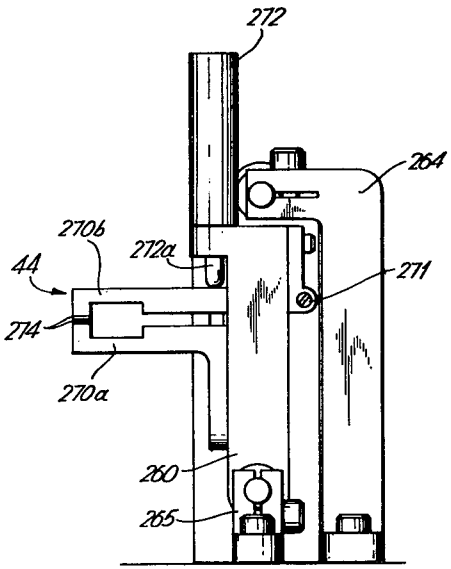
Figure 10:
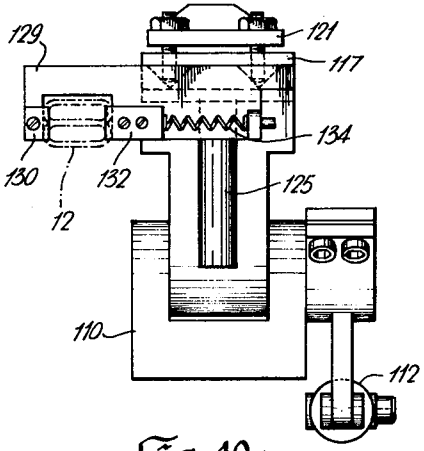

The left hand part of section A of the machine, which is particularly shown in FIGS. 5 to 7 and 8, and of which a component is shown in FIGS. 9 and 10, will now be described in detail.

The magazine assembly 22 for the buckles 12 includes a vertical tube 100 in which the buckles are vertically stacked. This tube is mounted by means of a bracket 101 attached to the machine bed and by a buckle supply assembly including two plates 103 which between them form a horizontal laterally extending passageway for horizontally disposed buckles which are pushed out of the magazine to a delivery point at the end of the passageway by a blade 104 operated by a pneumatic cylinder 105. The buckles in the tube 100 are urged downwardly by a weight to position them at the front end of blade 104.

The buckles leaving the magazine pass into the buckle holding and transfer device 26, which is shown in best detail in FIGS. 9 and 10. This device is mounted on a bracket 110 for pivotal movement about a horizontal fore and aft axis, and the device is movable by a pneumatic cylinder 112 from a generally vertical first (buckle receiving) position, indicated in FIG. 5, to a generally horizontal second threading position shown in FIGS. 5, 7, 8, 9 and 10. This device allows buckles to be positioned vertically adjacent the operative part of the sewing machine (between the sewing foot and the bed) without there being any attachments made to the sewing machine bed.

In accordance with one feature of the present invention, the holding and transfer device includes a main body part 114 which is directly, pivotally attached to bracket 110, and a buckle holder part 115 which, under circumstances to be described, is movable relative to part 114. Part 114 includes a box portion 117 having at its outer end a parallel sided recess in which is slideable a parallel sided lug 118 of the holder part, best shown in FIG. 9. The sides of lug 118 are parallel to the major surfaces of box part 117, so that when the device is in its second position as shown in FIG. 9 the holder part can move horizontally by the sliding of the lug 118 in its recess. Lug 118 can however be locked in position by two pins 120, shown by broken lines in FIG. 9, which are mounted at the outer end of a plate 121. This plate is pivoted centrally of the box part 117 at pivot 123, and is movable by a pneumatic cylinder 125 located near the pivot mounting of part 114 and having its piston rod 126 arranged to press the pins 120 into conically shaped recesses which occupy positions corresponding to pins 120 in the side of lug 118, as also shown in FIG. 9.

The buckle holder part 115 includes a plate member 129, having at one end a fixed member 130 with a groove for receiving one end edge of the buckle, and also slidably mounting a further grooved retainer member 132 which is urged towards member 130 by a spring 134. Members 130 and 132 are so arranged that when the device 26 is in its first, vertical position these members can receive between them the edges of a buckle which is pushed out of the magazine assembly by the blade 104. The spring 134 is sufficiently strong to hold the buckle firmly between members 130 and 132 while the device is pivoted by cylinder 112 from the first to the second position. During this movement, the position of holder part 115 is locked by extension of the cylinder 125. In its second position, the device 26 positions the buckle 12 adjacent the bed of the sewing machine 24.

The sewing machine 24 is a commercially available item known as a bar-tack machine and which is suitable for sewing of a zigzag type of seam across a tape. For this purpose, the sewing machine includes special means for moving its bed 140 and its sewing foot 142 through a predetermined path of movement while the needle remains stationary. One small addition to the commercial sewing machine is a vertical pin 143 extending upwardly from the bed and passing through an aligned bore in foot 142. This pin is positioned just to the rear of the tape when sewn, and serves a purpose in preventing unwanted movement in a manner described in our copending U.S. patent application Ser. No. 679,424 aforesaid.

The left hand part of section A also includes locking device 31 which is a blade movable by a cylinder 31*a* which is mounted at the side of the sewing machine nearest the device 26, and is inclined downwardly from this side of the sewing machine towards the position occupied by the buckle when in the second position of device 26. Cylinder 31*a* is coupled to a parallel air blast tube 32. Locking device 31 has two prongs engageable with the edges of a tape inserted by picker 30 and which straddle the clamping elements of the picker to hold the tape against the buckle and to prevent its withdrawal when the picker retracts. The are blast tube 32 causes the end of the tape, when free of the picker clamping elements, to be bent down when air is supplied to it. Also in this part of the machine is the blade 34, movable laterally by a pneumatic cylinder 34*a,* and which is aligned with the lower slot in the buckle when positioned as shown in FIG. 5*a* and which is suitable for tucking an end of the tape back through this lower slot after bending of the tape by the air blast, and for positioning the free end of the tape under the main part of the tape and under the needle of the sewing machine for sewing.

Figure 6:
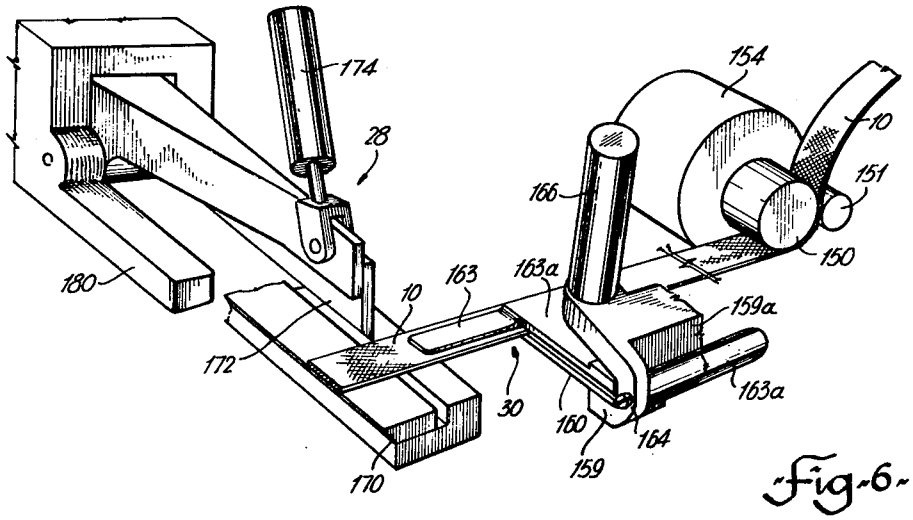

The right hand portion of section A will now be described with reference to FIG. 6, and also FIGS. 7 and 8.

The tape spool 20 is mounted above and to the rear of the machine on a spool holder 148 held by bracket 149, with the tape being led down through guides and then passed between a friction wheel 150 and a pressure roller 151, from which tape 10 passes horizontally under fingers 153 into picker 30 along a lateral path which is aligned with the buckle 12 in the sewing position. Friction wheel 150 is normally idle, but can be driven in such direction as to move the tape towards the right, for a purpose to be described.

The picker 30 comprises a carriage 155 movable on two vertically spaced, horizontal slide rods 157 which extend laterally, i.e. parallel to the desired path of tape movement from wheel 150 to the buckle in its sewing position. An arm 159 extends leftwards from carriage 155 and the front end of this carries a thin, flat member with a rearwardly extending part 160, and with a leftwards extending part 162. Part 162 cooperates with a similar upper member 163 carried by a part 163*a* which is pivotal relative to part 160 about pivot means indicated at 164. Part 163*a* is urged downwardly onto 162 by a piston rod of a pneumatic cylinder 166, which is mounted above part 163*a* on a fixed part 159*a* of the arm 159. Parts 162 and 163 together provide narrow projecting clamping elements capable of holding between them the free end of tape 10, and the thin, flat form of parts 160 and 162 allow these to advance the tape firstly over an anvil portion of the knife 28, and then through the upper slot of the buckle 12 held in the threading position by the device 26, elements 162 and 163 and the tape all passing through the slot. The necessary movement of the carriage 155 is provided by a pneumatic cylinder 168. The part 163*a* is spring urged upwardly, so that on release of pressure from cylinder 166 the picker can be withdrawn without withdrawing the tape. This arrangement is capable of accommodating various widths of tape.

The knife 28 operates with a scissors action, and includes a fixed anvil 170 having a horizontal surface just beneath the lowest surface of the picker element 162 (to allow this element to slide easily over the anvil), and the knife has a movable blade 172 pivotally attached to the rear of the anvil and movable by a pneumatic cylinder 174. The knife 28, spool holder bracket 149 with spool holder 148, and the friction wheel 150 and roller 151 and their associated mounting and driving means, are all mounted on a carriage 180 which is adjustable in lateral position on a bed 182. Also, knife 28 carries a rightwards extension with a stop member 184 which engages the picker carriage 155 and provides a stop for this carriage which ensures that the picker clamping elements 162, 163 are suitably spaced on the right hand side of anvil 170 when the knife operates. With this arrangement, the length of the first strap portion can readily be adjusted by shifting the position of the carriage 180 on bed 182, the picker travel corresponding to the total length of tape used in the first strap portion and being regulated by the position of stop member 184.

Detailed Description of Section B of Machine

Figure 12:
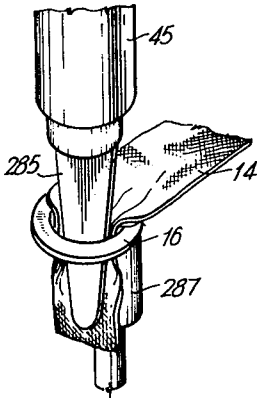
Figure 13:
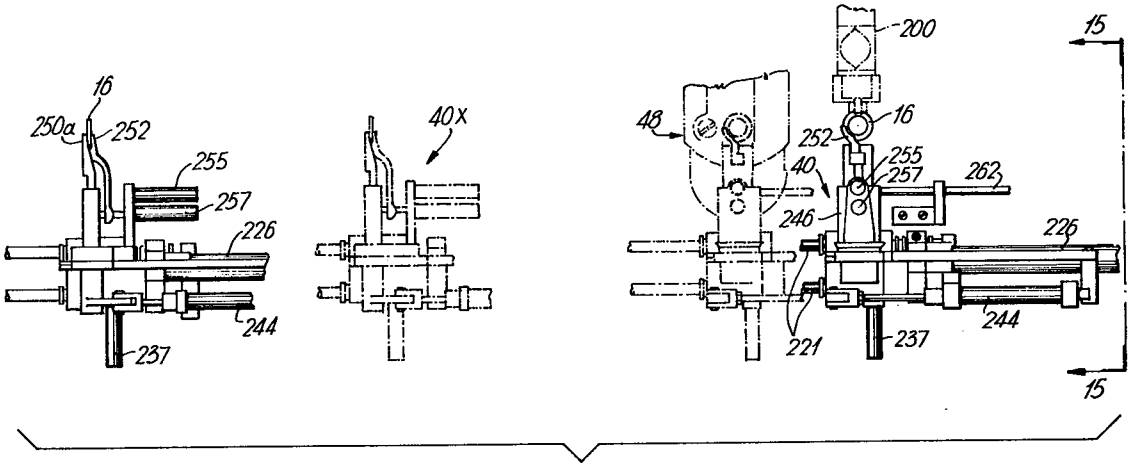
Figure 14:
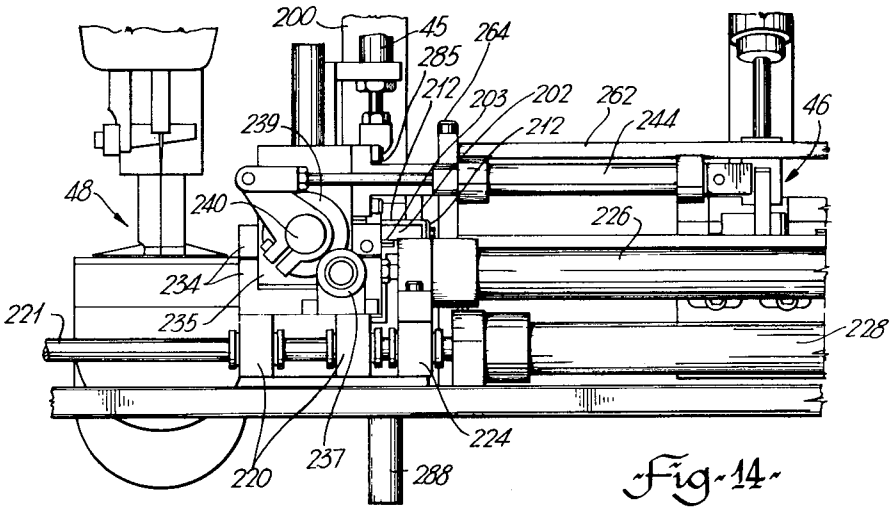
Figure 14A:
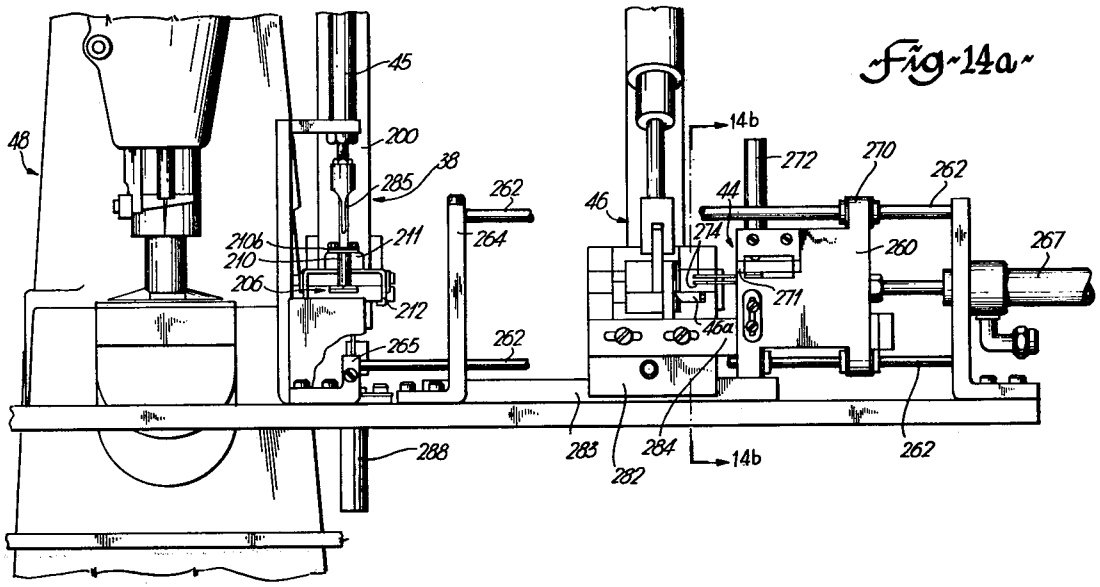
Figure 15:
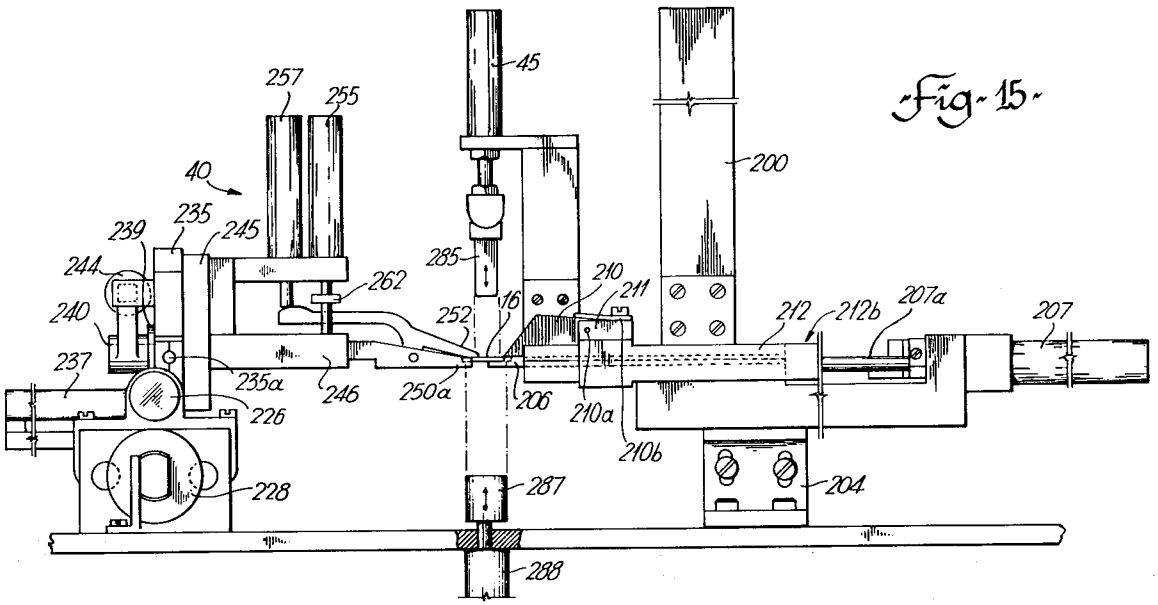
Figures 16, 16A:
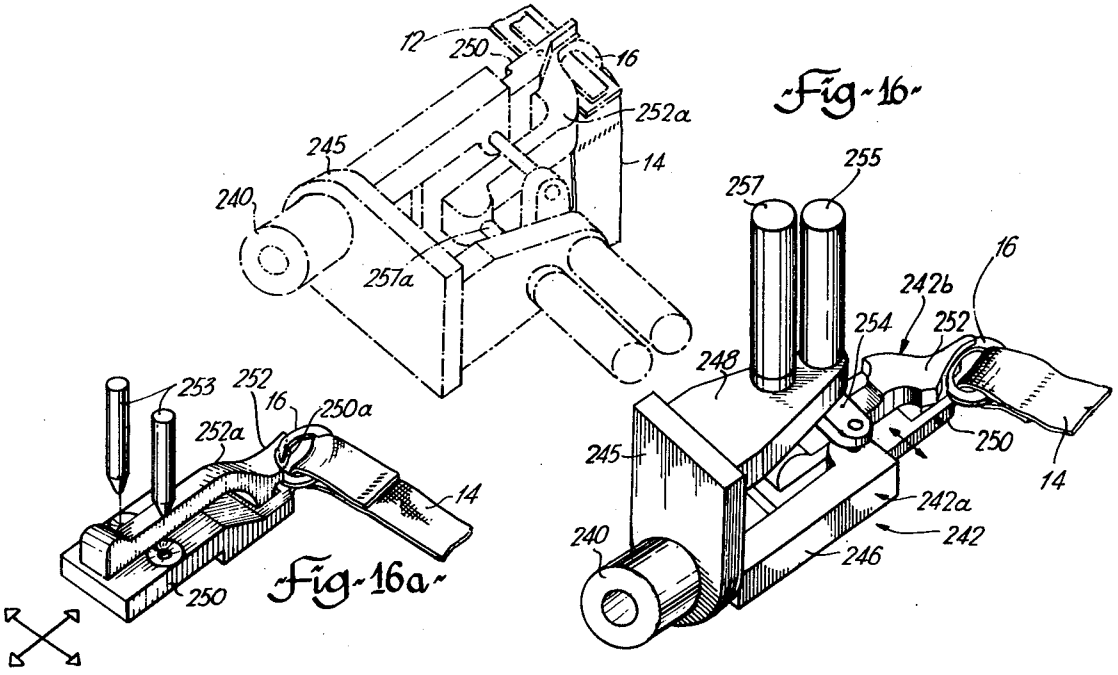
Figure 17:
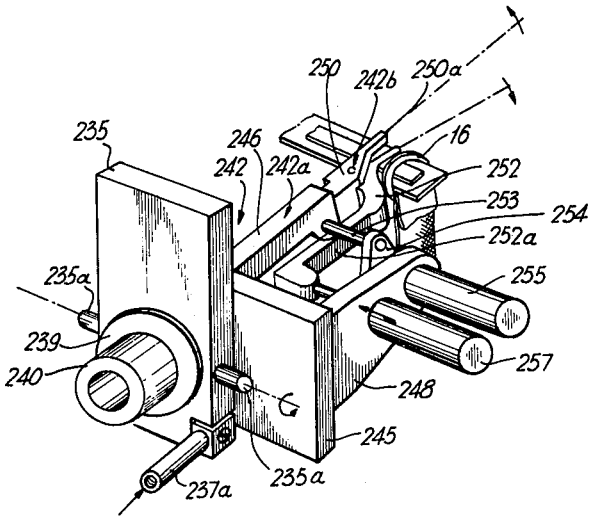

This section of the machine will now be described with reference to FIGS. 3B, 4B, and 11 to 17, of which FIGS. 14, 16 and 17 show detailed views of the ring holding and transfer device which is a main component of this section.

Figure 11:
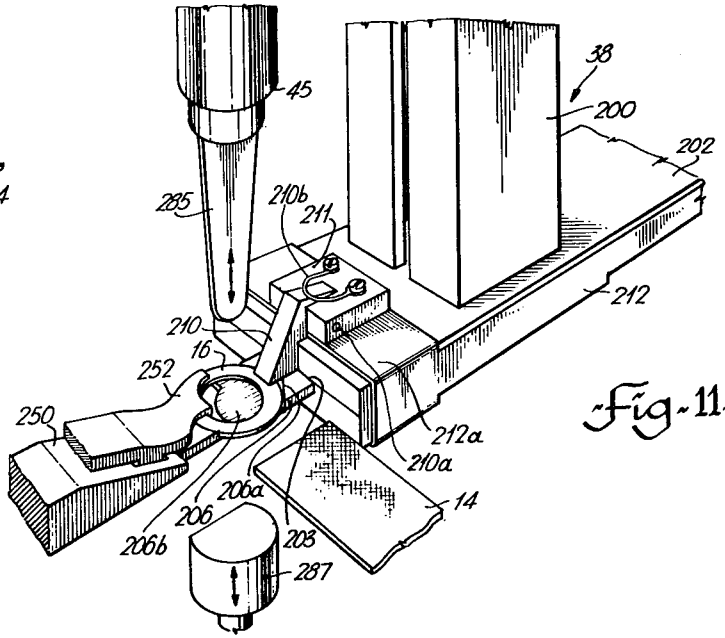

The magazine assembly 38 comprises a vertical tube 200 in which the rings 16 are vertically stacked, this tube extending upwardly from member 202 which forms a fore and aft extending slideway 203 for horizontally disposed rings, and which is itself supported on a bracket 204. Within slideway 203, a blade 206 is horizontally movable by pneumatic cylinder 207, to move the rings from the bottom of the stack in tube 200 to a delivery point which is also a threading position shown in FIGS. 2, 3, 11 and 12. As seen in FIG. 11, blade 206 has a cut away upper front portion for receiving the ring 16, this cut away portion being bounded by a V-shaped surface 206*a* which receives the side of the ring, and by a flat horizontal ring supporting surface 206*b.* As also shown in FIGS. 11, 12 and 13, the forward part of member 202 is provided with a vertical slot communicating with the centre of slideway 203, and in this slot is movable a holding element 210 which is connected by a transverse pivot 210*a* to a sliding block 211 in which element 210 is recessed. Block 211 is carried by inwardly extending forward portions 212*a* of two slide members 212 which are slideable along the outside of each side of the member 202, and which are connected at their rear ends by a cross member 212*b*. A lost-motion linkage is provided between the piston rod 207*a* of cylinder 207 and slide members 212, so that holding element 210 moves outwardly with blade 206 to retain the ring on surface 206*b*, and moves rearwardly with blade 206 but with shorter travel. The forward end of holding element 210 is urged down onto the ring 16 (when the ring is below this element) by a spring 210*b*. The holder element 210 cooperates with the blade 206 to hold a ring 16 in the recess formed by surfaces 206*a* and 206*b* while blade 206 is being extending until this ring has been successfully transferred to and clamped by the ring holding and transfer device 40, which will now be described.

The ring holding and transfer device 40, which will also be referred to as the multi-motion device and which incorporates further aspects of the invention, is shown in best detail in FIGS. 14 to 17.

Figures 1A, 1B:
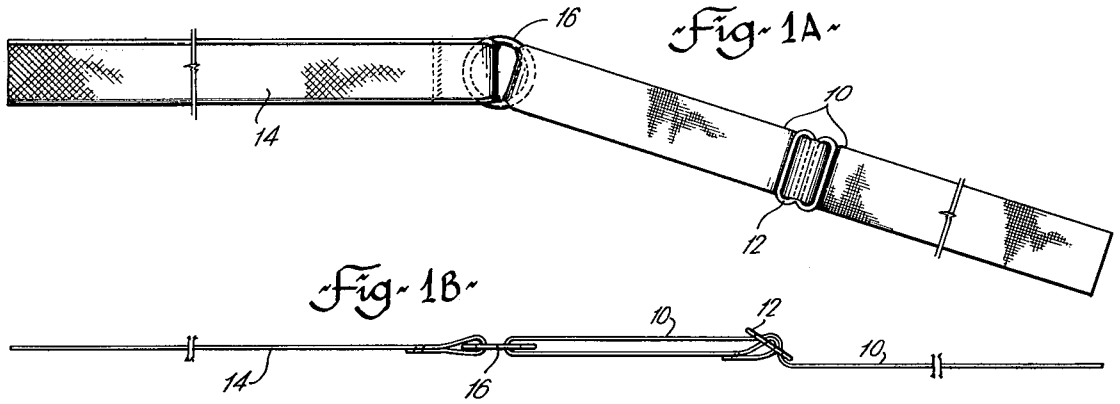
Figure 2:
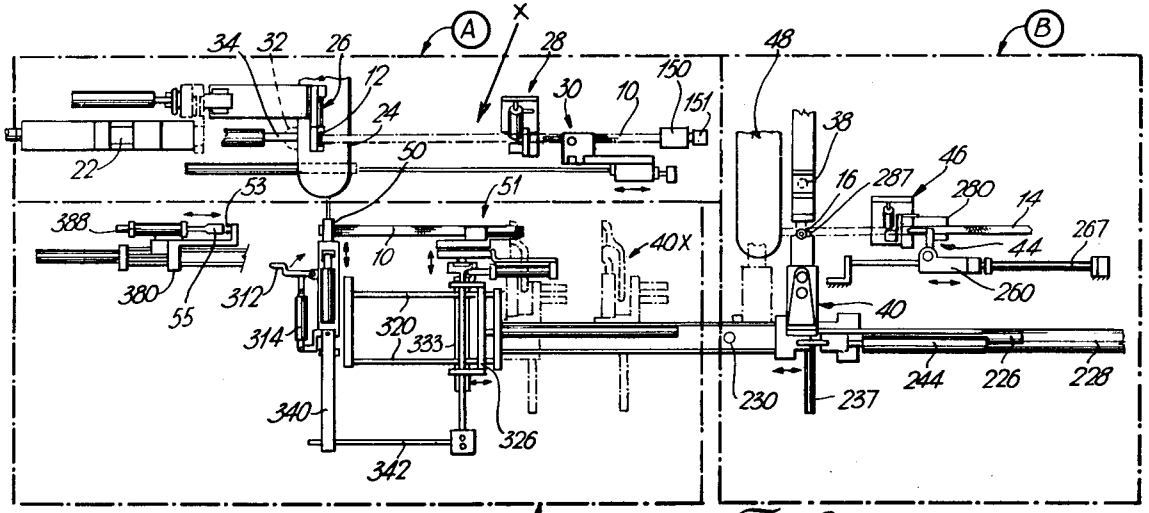
Figure 3A:
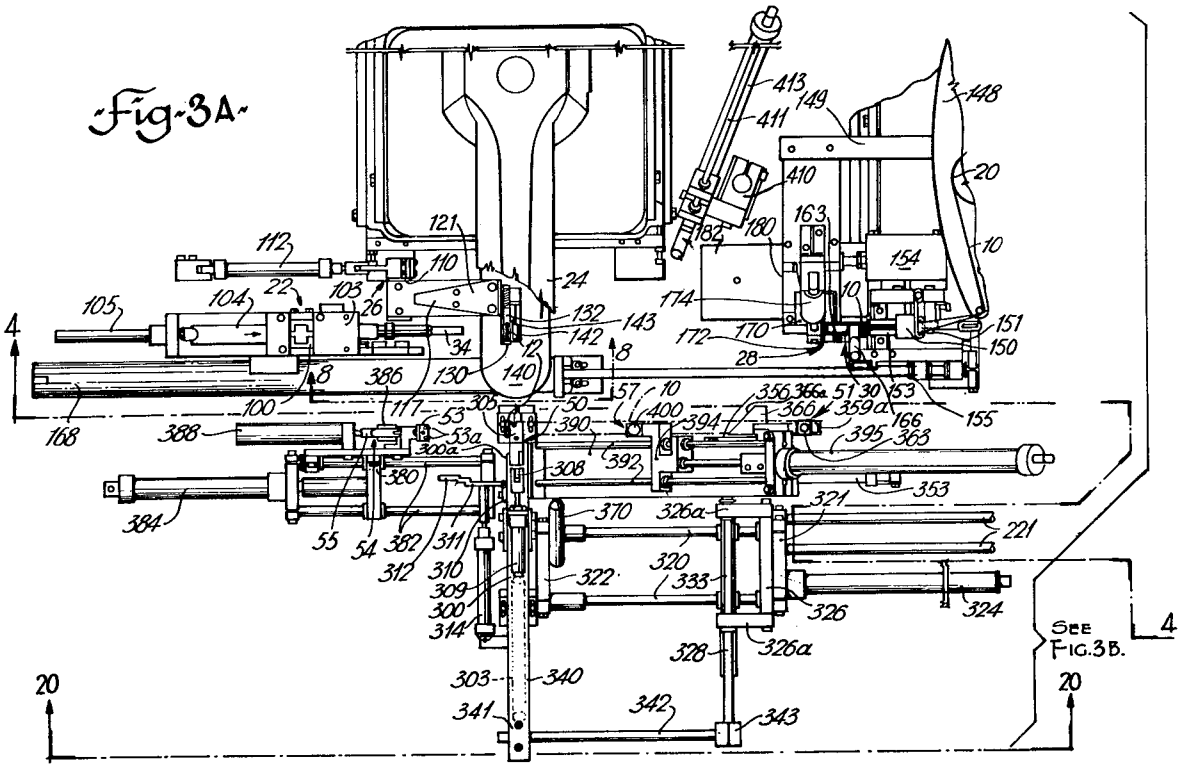
Figure 3B:
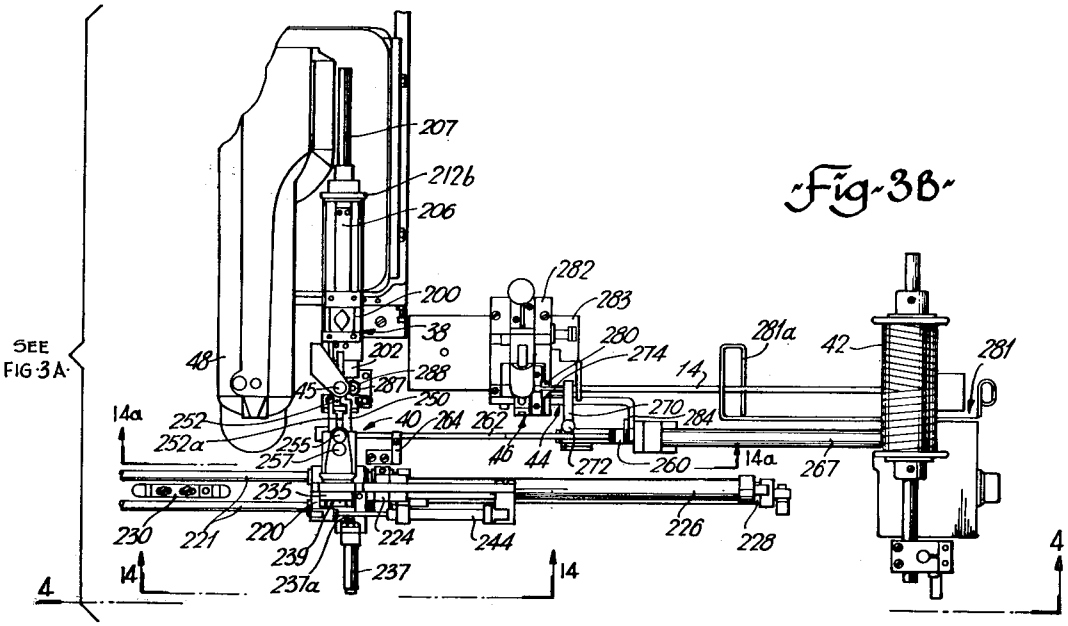
Figure 4A:
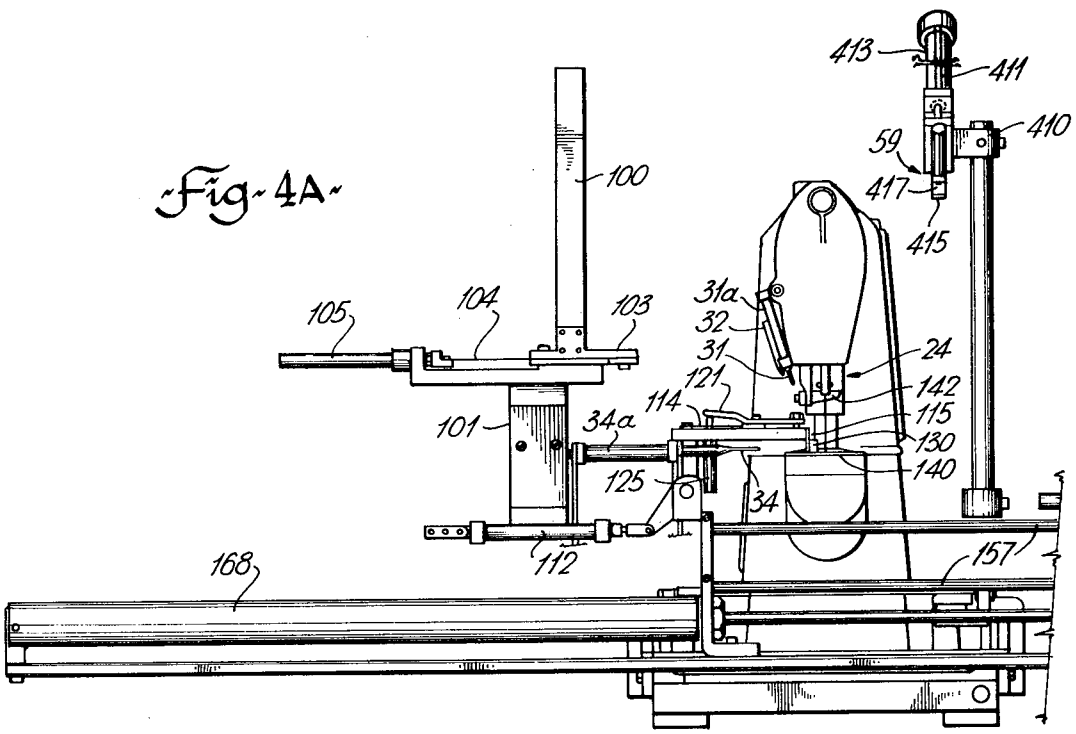
Figure 4B:
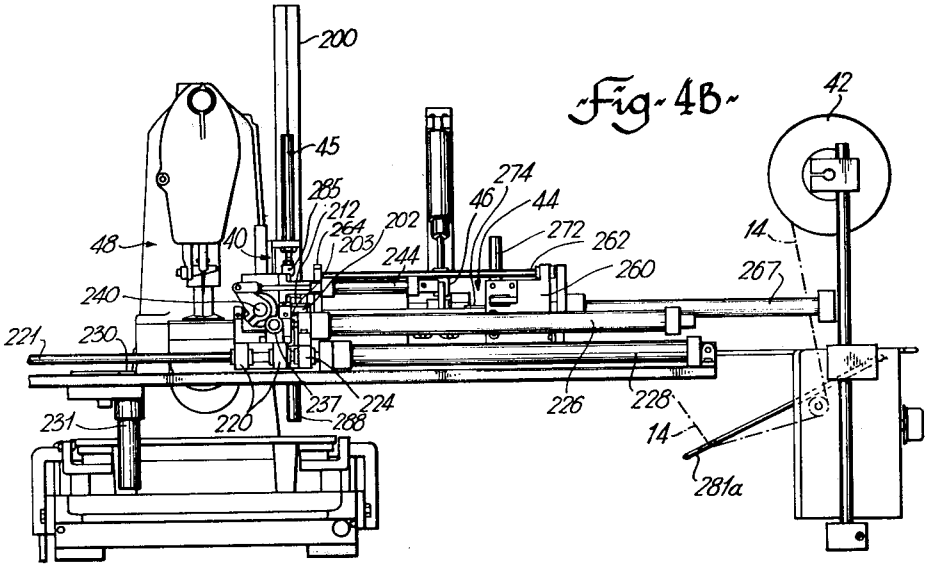
Figure 5:
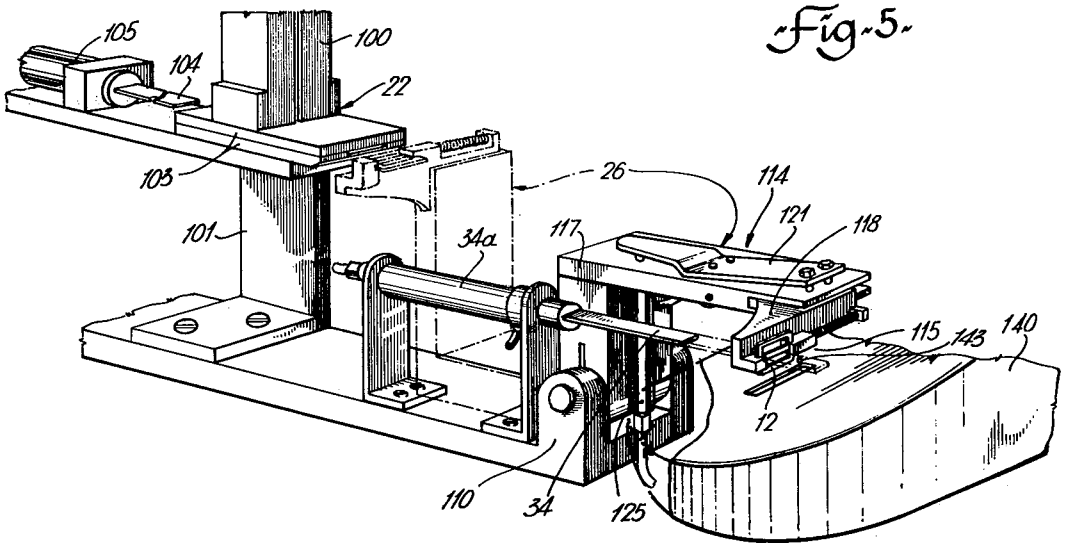

The mounting means for the multi-motion device 40 (i.e. ring holding and transfer device) will firstly be described with reference to FIGS. 3B, 4B and 14. The device is mounted on a first carriage 220 which is slideable on horizontally spaced guide rods 221 which extend laterally and are parallel to the direction of movement of elastic tape 14. Also movable on guide rods 221 is a second carriage 224 which carries a pneumatic cylinder 226 the piston rod of which is connected to carriage 220 for causing relative movement between the two carriages. Carriage 224 is itself movable by a large pneumatic cylinder 228. A stop member 230 (FIG. 4B) is arranged to be movable into the path of travel of the first carriage 220 by a stop member cylinder 231, and this is positioned so that stop member 230 can halt the movement of carriage 220 when the device 40 is in the sewing position, i.e. is holding the ring and elastic tape suitable for sewing of the elastic by the sewing machine 48. The arrangement is such that with the two cylinders 226 and 228 fully retracted the device 40 occupies a first position which is shown in full lines in FIGS. 2, 3B, 4B, 14 and 15, in which the device is suitably positioned for receiving the ring 16 from magazine assembly 38, and is also positioned in a threading station under the tape punch operated by cylinder 45. With the stop member 230 raised, cylinder 226 is then extended to move the carriage 220 against the stop member bringing the ring to the sewing position. In the sewing position the ring is at the left side of the sewing machine 48, i.e. on the side of the operative part of this machine opposite to the threading station. After sewing, stop member 230 can be retracted and cylinder 226 fully extended to move the device 40 to the holding position 40X shown in FIG. 2. Final movement of the device to feed the ring onto the end of the first tape held by the clamping devices of section C is achieved by extending the cylinder 228 to move both carriages 220 and 224.

The first carriage 220 has a fixed bracket 234 which has bearings which pivotally support trunnions 235*a* (FIG. 15) of a tilting portion of the device shown at 235. This tilting portion is movable through a small angle, say about 10°, by a pneumatic tilting cylinder 237 having piston rod extension 237*a* (FIG. 17). This has the effect of raising and lowering the ring holding end of the device, and the raising motion is used on releasing the ring after this has been fed onto the first tape carried by the clamping devices of section C, so that the ring clamp does not interfere with the ring when being retracted.

The tilting portion 235 carries a bearing 239 for a spindle 240 (see FIGS. 16 and 17) which supports a pivotable portion of the device, indicated generally at 242, this being pivotable through about 90° by a pivoting cylinder 244 (the pivoting portion also of course being tiltable by cylinder 237). Cylinder 244 allows the device to hold the ring either horizontally as required for threading and sewing, or vertically as required for feeding the ring onto the end of the first tape.

The pivoting portion 242 forms a sub-assembly (particularly shown in FIG. 16) which incorporates both a main body part 242*a* which is movable to suitably position a ring, and a ring holding part 242*b* which (in accordance with one aspect of the invention) is movable relative to part 242*a* during the sewing operation. The main body part includes in addition to spindle 240, a plate 245 extending perpendicularly to the spindle, a body member 246 extending outwardly from the spindle, and a bracket 248 spaced normally above and parallel to the member 246. The member 246 includes a parallel sided recess in which is slideable, both longitudinally and laterally, a part 250 (FIG. 16*a*) the outer end of which provides a lower clamping member 250*a*, forming part of the ring holding part 242*b*. An upper clamping member 252 is pivotally mounted near the outer end of part 250, and includes a rearwardly extending arm 252*a* which is urged by spring means (not shown) away from part 250 to provide a clamping action at the outer end. The clamping members 250*a* and 252 include curved recesses which receive the upper and lower surfaces of about ¼ of a ring inserted between these parts. By arranging for the clamping members to engage only a portion of the ring adjacent to or between mutually perpendicular diameters of the ring, the members can receive a ring from the fore-and-aft direction, and release the ring by relative lateral motion, i.e. motion perpendicular to the fore-and-aft direction. Thus, when the clamping members hold the ring vertically in position on the first strap portion 10 (as illustrated in the broken line portion of FIG. 16) they can be released and will clear the stationary ring upon upward movement of the clamping members caused by extension of tilting cylinder 237.

The upper portion of member 246 is centrally recessed to accommodate arm 252 and its movement while the part 250 slides laterally and longitudinally. As best shown in FIG. 16*a*, the part 250 is provided with two vertical bores, spaced on each side of arm 252*a*, and arranged to be engaged by the conical end portions of pins 253 held on the outer ends of a crosshead 254 mounted on the piston rod of a pin operating cylinder 255. When cylinder 255 is extended the pins 253 are pressed into engagement with the bores in part 250 and thus provide locking means which hold this firmly in place. When the cylinder is retracted the part 250, and with it the ring held by clamping members 250*a* and 252, is free to move with motions provided for by the sewing machine 48 which will be described. For opening the clamp at appropriate moments, a further pneumatic cylinder 257 is provided, having a piston rod 257*a* (broken line portion of FIG. 16) which can bear against the outer end of the arm 252*a* to open the clamp.

After the ring 16 has been transferred from the magazine to the multi-motion device 40, the elastic tape 14 is advanced by picker 44 over the top of the ring. The picker 44 receives the tape from spool 42 after this has passed through various guides, and between rollers 281 which advance the elastic automatically when slight tension occurs in the elastic as gauged by device 281*a;* this ensures that the elastic is supplied with little stretch. The picker 44 comprises a carriage 260 mounted on vertically spaced laterally extending guide rods 262. The guide rods 262 are held by brackets, including upper and lower brackets 264 and 265 at the left-hand end of the guide rods, of which the bracket 264 has its top portion extending rearwardly from its main vertical portion and being such that the main part of carriage 260 can pass behind this vertical portion when in its extreme left hand position. The carriage 260 is movable by cylinder 267. Two arms 270 extend from the rear of the left-hand side of carriage 260, these including a fixed lower arm 270*a* and an upper arm 270*b* which is pivotally mounted at 271 near the front of the carriage 260 and is arranged to be pivoted downwards by the piston rod 272*a* of a vertically mounted cylinder 272 and to be pivoted upwards by a spring. The outer ends of arms 270 carry clamping blades 274 which are narrow strips of metal suitable for receiving between them the elastic tape 14, and being engageable with this tape on extension of cylinder 272. The lower clamping blade of the picker is suitably shaped so that the picker can pass over the fixed lower anvil of knife 46 although holding the tape 14 close to this anvil.

An elastic tape clamp 280 is provided on the right-hand side of knife 46 and comprises upper and lower leaf springs which are each recessed for receiving the clamping blades 274 and with blades 274 on the right-hand side of knife 46. The clamp 280 prevents any return motion of the tape 14 due to the weight of the handling elastic.

Knife 46 is the same as knife 28 and will therefore not be described further. As with section A, knife 46 is mounted on a carriage 282 which also carries the clamp 280 and a stop member 284 for the picker carriage 260. Carriage 282 is adjustable along lateral slide 283 for adjustment of the length of elastic in the second strap portion. Whatever the adjustment, stop member 284 will stop rightwards movement of picker 44 so that clamping blades 274 are ½ inch or more to the right of the knife anvil; thus when the picker advances (after operation of the knife) it carries a free end of about ½ inch projecting from blades 274. The travel of the picker 44 is equal to the length of elastic in the strap portion.

The travel of picker 44 is such that in its left-hand (advanced) position it moves the free projecting end of tape 14, held between clamping blades 274, over the top of the ring 16 held by the multi-motion device 40 in its first, threading position, the blades 274 advancing just short of the center of the ring. For threading of the elastic, two devices are provided, which are best shown in FIG. 15, these being a punch in the form of a flat blade 285 vertically movable by cylinder 45, and a ring support member 287 vertically movable by cylinder 288. The member 287 is arranged so that when cylinder 288 is extended this member comes up to support the ring 16 against any possibility of being bent downwards or pushed out of the device 40, prior to punch 285 pushing the elastic tape 14 through the ring (FIG. 12) while still held by the picker.

The sewing machine 48 is again similar to that of section A, and so will not be described in detail. Again, this has a sewing foot which can descend to grip the elastic tape adjacent the ring 16, and when the ring has been moved to the sewing position by device 40, the outer end portion of the tape which has been folded underneath the remainder of the tape by movement of ring 16 onto the bed by device 40 is also gripped by the machine, so that after the pin operating cylinder 264 has unlocked the ring clamp a zig-zag seam can be sewn across the two thicknesses of elastic to hold the ring in place.

The detailed description of section C of the machine, which is not pertinent to the present invention, will be found in our aforesaid co-pending U.S. Pat. application Ser. No. 679,424.

OPERATION

Operation of the machine will now be described.

All the cylinders referred to above are pneumatic cylinders supplied with air through valves controlled by an automatic programmer, of the type sold under the trade name Agastat by Amerace-Esma Corporation, of the U.S.A.

Operations proceed simultaneously in sections A, B and C so that while a first strap portion is being formed in section B, section C is performing various buckling and associated operations which unite together two strap portions previously formed in sections A and B.

In Section A, a cycle starts with the buckle holder and transfer device 26 in the vertical position, with cylinder 125 extended to cause pins 120 to lock the buckle holder part 115 in position, with knife 28 open, and with picker 30 retracted to its right hand position, and with the picker clamping elements 162 and 163 held closed by the cylinder 166.

Cylinder 105 is then extended so that blade 104 pushes a buckle from the magazine 100 into the buckle holder 115, and then cylinder 112 is retracted to rotate the device 26 into the threading position (FIGS. 8 and 9) in which the buckle is held vertically near the sewing foot and bed of the sewing machine 24. Simultaneously, cylinder 168 is retracted to advance the picker 30, the clamping elements 162 and 163 of the picker pulling tape 10 from the supply spool between friction wheel 150 and roller 151, which are idle at this stage, and final movement of the picker threads the tape through the upper slot in the buckle until about ½ inch of the tape extends through this slot (see FIG. 8). Friction wheel 150 is then briefly driven in the reverse direction to tighten the tape 10. Cylinder 31*a* is then extended to bring locking fork 31 into contact with the tape 10 and to hold a part of the tape against the central portion of the buckle, so that when the picker clamping elements have been released from the tape the picker can return to its initial position without pulling the tape from the buckle. Simultaneously, a blast of air from the tube 32 turns down the end of tape which projects through the buckle, and then cylinder 34*a* moves the blade 34 through the lower slot in the buckle, and then immediately retracts this blade, to tuck the free end of the tape through the lower slot and into a position adjacent to and underneath the main portion of the tape and in suitable position for being sewn thereto by the sewing machine 24. With locking fork 31 retracted, the sewing machine foot moves down to clamp the two layers of tape against the sewing machine bed. The cylinder 125 of the buckle holder and transfer device is then retracted to release the holding part 115 and to allow this to slide around while the tape clamped by the sewing foot is moved by the sewing machine as this sews a zig-zag seam. After sewing cylinder 125 is again extended to lock part 115, the sewing foot is raised, and the picker clamping elements are closed.

At this stage, the first strap portion is virtually complete, except that it is still connected to the supply of tape. This strap portion is severed from the tape supply by knife 28 after it has been clamped by clamping members 50 and 51, as fully described in U.S. patent application Ser. No. 679,424 aforesaid.

In section B, the cycle begins with the picker 44 withdrawn to its rightward position, and picker clamp blades 274 closed by cylinder 272, and blades of knife 46 open. The multi-motion device 40 is in its right hand position shown in full lines in FIGS. 2*b* and 3 and has it rotatable portion suitably orientated by cylinder 244 so that the clamping members 250*a* and 252 can receive the ring 16 horizontally from magazine assembly 38. The tilting cylinder 237 is retracted. Also, cylinder 255 is extended to lock the clamping members relative to the main body part of device 40, and the clamping members 250*a* and 252 are held open by extension of cylinder 257.

The magazine blade 206 is advanced by cylinder 207 and moves ring 16 between the clamping members 250*a* and 252, undesired tilting of the ring being prevented by the holding element 210 which advances with the blade 206 during the latter part of its movement. The clamping members are then closed by spring action on retraction of cylinder 257 (see FIG. 11), and blade 206 and element 210 withdraw leaving the ring held horizontally in the device 40.

Previous operations have left an end portion about one half inch in length of the tape 14 extending in advance of the clamping blades 274 of picker 44. The picker is advanced under the action of cylinder 267 and moves this end portion of the tape over the top or ring 16, the picker advancing to a position in which its blades 274 are just short of the center line of the ring. The ring support member 287 is then raised by cylinder 288 into position to prevent downward movement of the ring 16, and shortly afterwards punch 285 is moved downwardly by cylinder 5 to move the end portion of tape 14, previously lying across the top of the ring, into position in which it hangs through the ring (see FIG. 12). While the punch remains down, picker blades 274 open and the picker retracts to its initial position leaving the elastic threaded. The friction between the sides of the elastic tape and the ring is sufficient to prevent rightward movement of the tape. Also, spring clamp 280 at this point prevents the weight of the elastic tape leading from the supply spool from causing reverse movement of the tape. The ring support member 287 and punch 285 then retract away from the ring. Picker blades 274 again close, and knife 46 then operates to sever a suitable length of tape about ½ inch in front of blades 274, thus severing the length of tape required for the second strap portion.

With stop member 230 raised, cylinder 226 is extended to move the multimotion device 40 against the stop member 230 and into a position in which it holds the ring 16 in its sewing position just at the left hand side of the operative portion of sewing machine 48. This movement folds the previously hanging end portion of tape 14 back underneath the main portion of the tape so that the two thicknesses of tape can be held together by the sewing foot which now descends onto the bed of the sewing machine. Cylinder 255 of the multi-motion device then retracts to unlock the holding part including clamping members 250*a* and 252, to allow the two tape thicknesses adjacent the ring to be sewn together with a zig zag seam while the part 250 slides around in body member 246. After sewing, the cylinder 255 again locks the clamping members in position while the sewing foot is raised. Stop member 230 is then retracted and cylinder 226 fully extended to move the multi-motion device 40 to its holding position 40X (FIG. 2), and simultaneously cylinder 244 rotates the rotatably part of this device to orientate the ring in vertical position with the attached tape hanging from the lower side of the ring.

The operations described above have produced first and second strap portions, both sewn to the respective buckle or ring element by zig-zag seams in accordance with the invention.

The embodiments of the present invention in which an exclusive property or privilege is claimed are defined as follows:

1. A device for holding an element such as a ring, buckle, or the like while said element is being sewn onto a tape by a sewing machine equipped with a sewing foot and bed capable of moving a tape clamped therebetween through a predetermined path to sew a non-linear seam across the tape, said device comprising a main body part and a holding part, said holding part having clamping means for said element, said body part being movable to suitably position said holding part firstly in a receiving position to receive said element from a supply source and secondly in a sewing position in which said element is disposed adjacent said foot and bed of the sewing machine and so positioned that after threading of said tape through said element parts of said tape adjacent said element may be clamped between said foot and said bed for sewing, and said holding part and said body part having inter-engaging sliding surfaces for movement of said holding part relative to the body part in a plane parallel to those parts of the tape clamped by said foot and bed when the body part is in said sewing position, said body part including releasable locking means for locking said holding part firmly in said body part during transfer of an element from said supply source to said holding part and during movement of said device to the sewing position, said locking means being releasable when the device is in the sewing position so that the holding part is free to move with the tape being sewn which is moved through said predetermined path by the sewing foot and bed.

2. A device according to claim 1, wherein said locking means include two spaced pins slidable in bores in said body part and engageable in recesses in said holding part, and fluid cylinder means mounted on said body part for urging said pins into said recesses in the holding part.

3. A device according to claim 1 wherein said element is a buckle and including a pivot mounting for said main body part, means for pivoting said main body part through about a right angle to firstly position the holding part to receive horizontally disposed buckle elements supplied from said source and to move the buckles into a second, threading position in which the buckles are vertically disposed adjacent the operative part of the sewing machine, said holding part engaging edges of the buckle to allow threading of tape through both slots of the buckle while the buckle is held in the threading position by the holding part.

4. A device according to claim 3, wherein said main body part includes a parallel sided recess, wherein said holding part includes a parallel sided portion slidable within said recess, and wherein said clamping means are arranged to hold said buckle perpendicularly to the sliding surface of said parallel sided portion.

5. A device according to claim 4 wherein said locking means include pins slidable in said main body part to engage in correspondingly positioned recesses in said parallel sided portion to lock said portion firmly in said parallel sided recess of the body part and wherein said pins are movable into said correspondingly positioned recesses by cylinder means located near the pivot mounting of said body part.

6. A device according to claim 1 wherein said element is a ring and wherein said main body part is mounted on a horizontally movable carriage movable from a threading position to a sewing position at the side of the operative part of a sewing machine remote from the threading position, whereby movement of the ring from the threading to the sewing position causes an end portion of the tape which has been pushed through the ring to be doubled over against the main portion of the tape, to provide adjacent parts of tape which can move through said predetermined path by the sewing foot and bed.

7. Apparatus for securing an element such as a ring, buckle, or the like on to a tape by sewing, comprising:

a sewing machine euipped with a sewing foot and bed capable of moving a tape clamped therebetween through a predetermined path to sew a non-liner seam across the tape, a source of supply of said elements, a holding and transfer device for receiving one of said elements from said source and holding said element clamped, a source of supply of said tape, means for feeding said tape to a position adjacent said element and for feeding a free end of said tape through said element while the element is held by the holding and transfer device:

wherein said holding and transfer device includes a main body part and a holding part said holding part having clamping means for said elements, said body part being movable to suitably position said holding part firstly in a receiving position to receive said elemement from the supply source and secondly in a sewing position in which said element is disposed adjacent said foot and bed of the sewing machine and so positioned that after threading of said tape through said element parts of said tape adjacent said element may be clamped between said foot and said bed for sewing, and said holding part and said body part having inter-engaging sliding surfaces for movement of said holding part relative to the body part in a plane parallel to those parts of the tape clamped by said foot and bed when the body part is in said sewing position, said body part including releasable locking means for locking said holding part firmly in said body part during tranfer of an element from said supply source to said holding part and during movement of said device to the sewing position, said locking means being releasable when the device is in the sewing position, so that the holding part is free to move with the tape being sewn which is moved through said predetermined path by the sewing foot and bed.

8. Apparatus according to claim 7 wherein said element is a buckle and including a pivot mounting for said main body part of the holding and transfer device, and means for pivoting said main body part through about a right angle to firstly position the holding part to receive horizontally disposed buckle elements supplied from said source and to move the buckles into a second, threading position in which the buckles are vertically disposed adjacent the operative part of the sewing machine, said holding part engaging edges of the buckle to allow threading of tape through both slots of the buckle while the buckle is held in the threading position by the holding part.

9. Apparatus according to claim 7, wherein said element is a ring and including a horizontally movable carriage mounting said main body part of the ring holding and transfer device, said apparatus also including a threading station having a tape threading punch which is positioned to punch the end portion of a tape through a ring held by said holding part when the tape and ring have been placed in overlapping relationship, said carriage being operative to move the ring holding and transfer device from said threading station to a sewing position which is at the side of the operative part of a sewing machine remote from the threading station, whereby movement of the ring from the threading station to the sewing position causes the end portion of the tape which has been pushed through the ring to be doubled over against the main portion of the tape, to provide adjacent parts of tape which can be sewn together in the operative part of the sewing machine.

10. Apparatus for securing a ring element to a tape including a joining machine, means for supplying horizontally disposed ring elements to a delivery point, a ring holding and transfer device arranged to receive the horizontally disposed elements when fed thereto by delivery means, said holding and transfer device including clamping means for said elements which clamping means are such as to engage only around a minor portion of the periphery of the element whereby both said delivery means and said clamping means can simultaneously hold parts of a ring element, tape advancing means for advancing tape in a first direction to position a free end of the tape in overlapping relationship with the ring element as held by the holding and transfer device, means for temporarily supporting the element, means for punching a free end portion of the tape through the ring element while held by said clamping means and supported by said support means, and means for moving the holding and transfer device to move the element horizontally in said first direction through the operative part of a joining machine in such manner that the free end portion of the tape engages a bed of the machine and is folded alongside a main portion of the tape to position both thickness of tape in the operative part of the joining machine.

11. Apparatus according to claim 10, wherein said tape advancing means includes a horizontally movable carriage supporting clamping elements for the tape material, and wherein said carriage is movable from the retracted position to an advanced position in which advanced position the clamping elements are positioned over a portion of the ring and just short of the path of the movement of the punching means, the travel of said carriage corresponding to the length of tape required to be attached to the ring, and further comprising knife means operable when the threading means is in retracted position to sever the tape at a point suffficiently in advance of the outer end of the clamping elements to provide an end portion of the tape suitable for threading through the ring.

12. Apparatus according to claim 10, wherein said clamping means for the ring element are such as to receive about one quarter of the periphery of the ring element whereby said clamping means can receive an element in a first direction of movement relative to the clamping means and can release the element by movement in a second direction of relative movement perpendicular to said first direction.

13. A method for securing a ring element to a tape including the steps of:

supplying a horizontally disposed ring element to a delivery point and inserting said element in a ring holding and transfer device, and holding said element in said device by minor portion of its periphery, advancing tape in a first direction to position a free end of the tape in overlapping relationship with the element, placing a support under a portion of said element not engaged by the holding and transfer device, punching a free end portion of the tape through the element, withdrawing said support, moving the element horizontally in said first direction through the operative part of a joining machine in such manner that the free end portion of the tape engages a bed of the machine and is folded alongside a main portion of the tape to position both thickness of tape in the operative part of the joining machine, and operating said joining machine to join the free end portion of tape to the main portion of the tape.

14. Apparatus for threading first and second tapes through a ring element and for securing said second tape to said element, comprising:

means for holding an end of said first tape extended in first horizontal direction, a ring holding and transfer device arranged to receive a said ring element when horizontally disposed, tape advancing means for advancing the second tape in a horizontal direction close to said first horizontal direction to position a free end of the tape in overlapping relation with said ring element held by said device, means for punching a free end portion of the tape through the ring while held by said clamping means, means for moving said device horizontally to move said ring element in a path close to said first horizontal direction, through the operative part of a joining machine in such manner that the free end portion of the tape engages a bed of the machine and is folded alongside a main portion of the tape to place both portions of tape in the operative part of the machine to allow said portions to be joined together to secure the element to said second tape, rotating a ring holding portion of said device to orientate said ring element in a vertical plane, and means for advancing said device further with the vertically orientated ring moving in said first horizontal direction for feeding said ring onto the said end of said first tape.

15. Apparatus according to claim 14, wherein said ring holding and transfer device has clamping means for the ring element which are such as to receive about one quarter the periphery of the ring element whereby said clamping means can receive a ring in a horizontal direction of movement perpendicular to said first horizontal direction and whereby, after rotation of the ring into the horizontal plane and feeding of the ring onto said end of the first tape, the clamping means can release the ring by vertical movement relative thereto, said apparatus further comprising means for temporarily supporting the ring element during punching of the tape therethrough.

* * * * *